US009855643B2

(12) United States Patent
Coffland

(10) Patent No.: US 9,855,643 B2
(45) Date of Patent: Jan. 2, 2018

(54) TORQUE-WRENCH APPARATUSES AND METHODS OF ASSEMBLING THE SAME

(71) Applicant: THE BOEING COMPANY, Chicago, IL (US)

(72) Inventor: Donald Wayne Coffland, Seattle, WA (US)

(73) Assignee: THE BOEING COMPANY, Chicago, IL (US)

( * ) Notice: Subject to any disclaimer, the term of this patent is extended or adjusted under 35 U.S.C. 154(b) by 352 days.

(21) Appl. No.: 14/600,509

(22) Filed: Jan. 20, 2015

(65) Prior Publication Data

US 2016/0207181 A1 Jul. 21, 2016

(51) Int. Cl.

*B25B 23/142* (2006.01)
*B25B 23/00* (2006.01)
*B25B 13/48* (2006.01)

(52) U.S. Cl.

CPC ..... *B25B 23/1427* (2013.01); *B25B 23/0028* (2013.01); *B25B 13/481* (2013.01)

(58) Field of Classification Search

CPC ..... B25B 13/481; B25B 23/0028; B25B 23/0035; B25B 23/142; B25B 23/1427
USPC ..... 81/478
See application file for complete search history.

(56) References Cited

U.S. PATENT DOCUMENTS 1,574,865 A * 3/1926 Boykin, Jr. ..... B25B 13/52 81/478
3,964,351 A 6/1976 Tsuji
4,732,062 A 3/1988 Grabovac et al.
6,119,562 A 9/2000 Jenkins
6,162,053 A 12/2000 Hollander
7,806,027 B1 * 10/2010 Gao ..... B25B 13/463 81/482
8,806,993 B2 8/2014 Coffland
2007/0295174 A1 12/2007 Hsieh
2011/0185862 A1 * 8/2011 Coffland ..... B25B 23/1427 81/478
2011/0185863 A1 8/2011 Hsieh

FOREIGN PATENT DOCUMENTS

| | | |
|---|---|---|
| DE | 91999 | 11/1954 |
| DE | 925458 | 3/1955 |
| FR | 1028544 | 5/1953 |
| FR | 1034602 | 7/1953 |
| FR | 2584330 | 1/1987 |
| WO | 02070208 | 12/2002 |

* cited by examiner

*Primary Examiner* — Hadi Shakeri
(74) *Attorney, Agent, or Firm* — Joseph F. Harding; The Small Patent Law Group, LLC

(57) ABSTRACT

A torque-wrench attachment (100) comprises a chassis (140) and a wrench head (110) comprising a second longitudinal central axis (203) and a torque axis (112). The torque axis (112) of the wrench head (110) has an adjustable angle (190) relative to a first longitudinal central axis (202) of a torque-wrench handle (200). The torque-wrench attachment (100) also comprises a link (150) and a translating element (160). The translating element (160) comprises a contact surface (162). The contact surface (162) is movable along the first longitudinal central axis (202), and a moment arm (180) between the click-pivot axis (144) and a centroid (602) varies as a function of the adjustable angle (190).

20 Claims, 9 Drawing Sheets

TORQUE-WRENCH APPARATUSES AND METHODS OF ASSEMBLING THE SAME

BACKGROUND

Torque wrenches are commonly used for accurate application of torque to fasteners, such as nuts or bolts. However, fasteners may be located in confined spaces, requiring the use of wrench extensions and/or adaptors to apply torque. When using extensions or adaptors with torque wrenches, correction factors may be required to ensure that a proper torque is being delivered to the fastener. Correction factors are related to the geometry of the extensions or adaptors and must be computed for each operation requiring a different extension or adaptor and/or a different torque. Such computations are time consuming and may be subject to error.

SUMMARY

Accordingly, apparatuses and methods, intended to address the above-identified concerns, would find utility.

The following is a non-exhaustive list of examples, which may or may not be claimed, of the subject matter according the present disclosure.

One example of the present disclosure relates to a torque-wrench attachment configured to be coupled to a torque-wrench handle. The torque-wrench handle defines a first longitudinal central axis and comprises a torque-wrench handle barrel and a force-application member, rotatable relative to the torque-wrench handle barrel about a click-pivot axis perpendicular to the first longitudinal central axis. The torque-wrench attachment comprises a chassis configured to be coupled to the torque-wrench handle barrel. The torque-wrench attachment also comprises a wrench head comprising a second longitudinal central axis and a torque axis. The wrench head is shaped to engage at least one of a fastener or a torque-application adaptor aligned with the torque axis. The second longitudinal central axis and the torque axis have an intersection point. The torque axis of the wrench head has an adjustable angle relative to the first longitudinal central axis of the torque-wrench handle when the chassis is coupled to the torque-wrench handle barrel and aligned with the first longitudinal central axis. The torque-wrench attachment also comprises a link pivotally coupled to the chassis and the wrench head. The torque-wrench attachment additionally comprises a translating element pivotally coupled to the wrench head and linearly movable relative to the chassis. The translating element comprises a contact surface having a centroid and configured to receive a first force from the force-application member when the chassis is coupled to the torque-wrench handle barrel and aligned with the first longitudinal central axis, the wrench head engages the fastener, and a second force is applied to the torque-wrench handle in an opposite direction to the first force. When the chassis is coupled to the torque-wrench handle barrel and aligned with the first longitudinal central axis, the contact surface of the translating element is movable along the first longitudinal central axis of the torque-wrench handle, and a moment arm between the click-pivot axis and the centroid of the contact surface of the translating element along the first longitudinal central axis of the torque-wrench handle varies as a function of the adjustable angle between the torque axis of the wrench head and the first longitudinal central axis.

Another example of the present disclosure relates to a torque wrench comprising a torque-wrench handle defining a first longitudinal central axis and comprising a torque-wrench handle barrel. The torque wrench also comprises a click-type torque-wrench mechanism comprising a force-application member extending from the torque-wrench handle barrel. The force-application member is rotatable relative to the torque-wrench handle barrel about a click-pivot axis perpendicular to the first longitudinal central axis. The torque wrench additionally comprises a torque-wrench attachment coupled to the torque-wrench handle. The torque-wrench attachment comprises a chassis coupled to the torque-wrench handle barrel. The torque-wrench attachment also comprises a wrench head comprising a second longitudinal central axis and a torque axis. The wrench head is shaped to engage at least one of a fastener or a torque-application member aligned with the torque axis. The second longitudinal central axis and the torque axis have an intersection point. The torque axis of the wrench head has an adjustable angle relative to the first longitudinal central axis of the torque-wrench handle when the chassis is aligned with the first longitudinal central axis. The torque-wrench attachment additionally comprises a link, pivotally coupled to the chassis and the wrench head. The torque-wrench attachment also comprises a translating element pivotally coupled to the wrench head and linearly movable relative to the chassis. The translating element comprises a contact surface having a centroid and configured to receive a first force from the force-application member when the chassis is aligned with the first longitudinal central axis, the wrench head engages the fastener, and a second force is applied to the torque-wrench handle in an opposite direction to the first force. When the chassis is aligned with the first longitudinal central axis, the contact surface of the translating element is movable along the first longitudinal central axis of the torque-wrench handle, and a moment arm between the click-pivot axis and the centroid of the contact surface of the translating element along the first longitudinal central axis of the torque-wrench handle varies as a function of the adjustable angle between the torque axis of the wrench head and the first longitudinal central axis.

Yet another example of the present disclosure relates to a method of assembling a torque wrench. The method comprises providing a torque-wrench handle and a click-type torque-wrench mechanism. The torque-wrench handle defines a first longitudinal central axis and comprises a torque-wrench handle barrel. The click-type torque wrench mechanism comprises a force-application member extending from the torque-wrench handle barrel. The force-application member is rotatable relative to the torque-wrench handle barrel about a click-pivot axis perpendicular to the first longitudinal central axis. The method also comprises mounting a torque-wrench attachment to the torque-wrench handle. The torque-wrench attachment comprises a chassis configured to be coupled to the torque-wrench handle barrel. The torque-wrench attachment also comprises a wrench head comprising a second longitudinal central axis and a torque axis. The wrench head is shaped to engage at least one of a fastener or a torque-application member aligned with the torque axis. The second longitudinal central axis and the torque axis have an intersection point. The torque axis of the wrench head has an adjustable angle relative to the first longitudinal central axis of the torque-wrench handle when the chassis is coupled to the torque-wrench handle barrel and aligned with the first longitudinal central axis. The torque-wrench attachment additionally comprises a link pivotally coupled to the chassis and the wrench head. The torque-wrench attachment also comprises a translating element pivotally coupled to the wrench head and linearly movable relative to the chassis. The translating element comprises a contact surface having a centroid and configured to receive a first force from the force-application member when the chassis is coupled to the torque-wrench handle barrel and aligned with the first longitudinal central axis, the wrench head engages the fastener, and a second force is applied to the torque-wrench handle in an opposite direction to the first force. When the chassis is pivotally coupled to the torque-wrench handle barrel and aligned with the first longitudinal central axis, the contact surface of the translating element is movable along the first longitudinal central axis of the torque-wrench handle, and a moment arm between the click-pivot axis and the centroid of the contact surface of the translating element along the first longitudinal central axis of the torque-wrench handle varies as a function of the adjustable angle between the torque axis of the wrench head and the first longitudinal central axis.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a block diagram of a torque wrench, according to one or more examples of the present disclosure;

FIG. 2 is a schematic, perspective view of the torque wrench of FIG. 1, according to one or more examples of the present disclosure;

FIG. 3 is a schematic, perspective view of the torque wrench of FIG. 1, according to one or more examples of the present disclosure;

FIG. 4 is a schematic side elevation view of the torque wrench of FIG. 1, according to one or more examples of the present disclosure;

FIG. 5 is a schematic side elevation view of the torque wrench of FIG. 1, according to one or more examples of the present disclosure;

FIG. 6 is a schematic plan view of the torque wrench of FIG. 1, according to one or more examples of the present disclosure;

FIG. 7 is a schematic plan view of the torque wrench of FIG. 1, according to one or more examples of the present disclosure;

FIG. 8 is a schematic sectional plan view of a prior art torque-wrench handle;

FIG. 9 is a schematic partially sectioned side view of a prior art torque-wrench handle;

FIG. 10 is a block diagram of a method of assembling a torque wrench, according to one or more examples of the present disclosure;

FIG. 11A is a schematic side view of the torque wrench of FIG. 1 with the second longitudinal central axis parallel to the first longitudinal central axis, according to one or more examples of the present disclosure;

Figure 1:
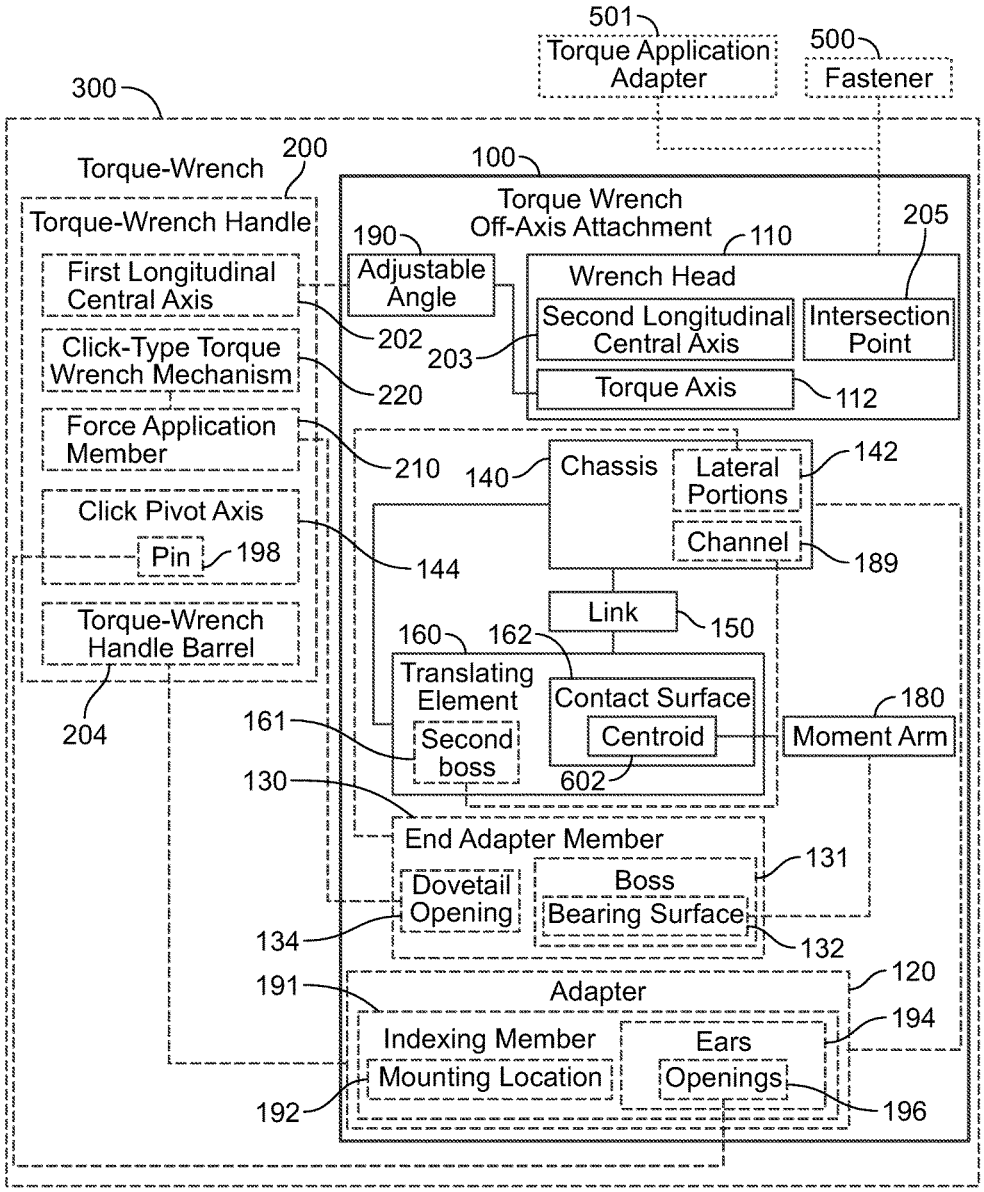
Figure 2:
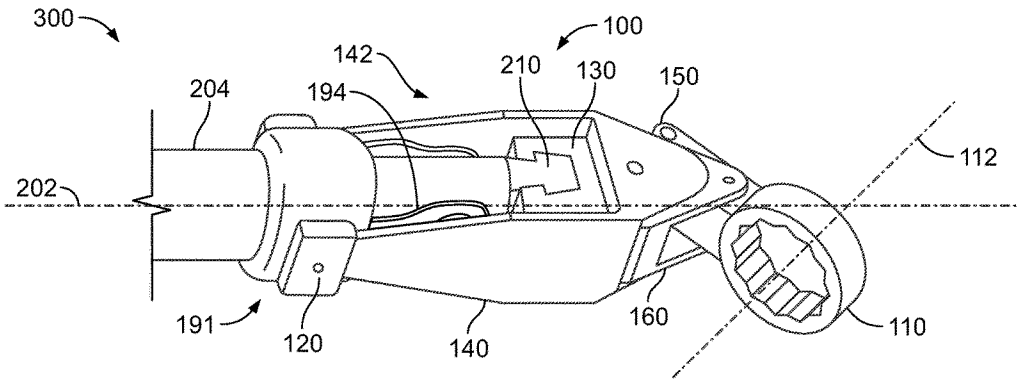
Figure 3:
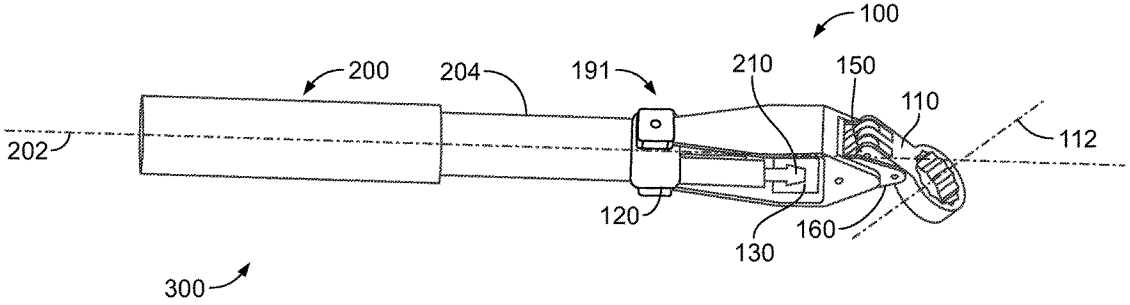
Figure 4:
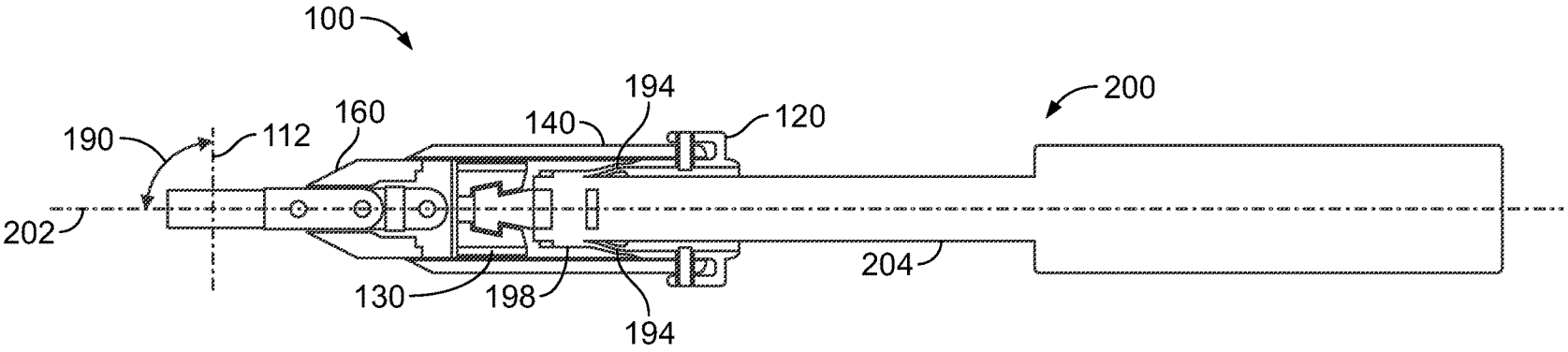
Figure 5:
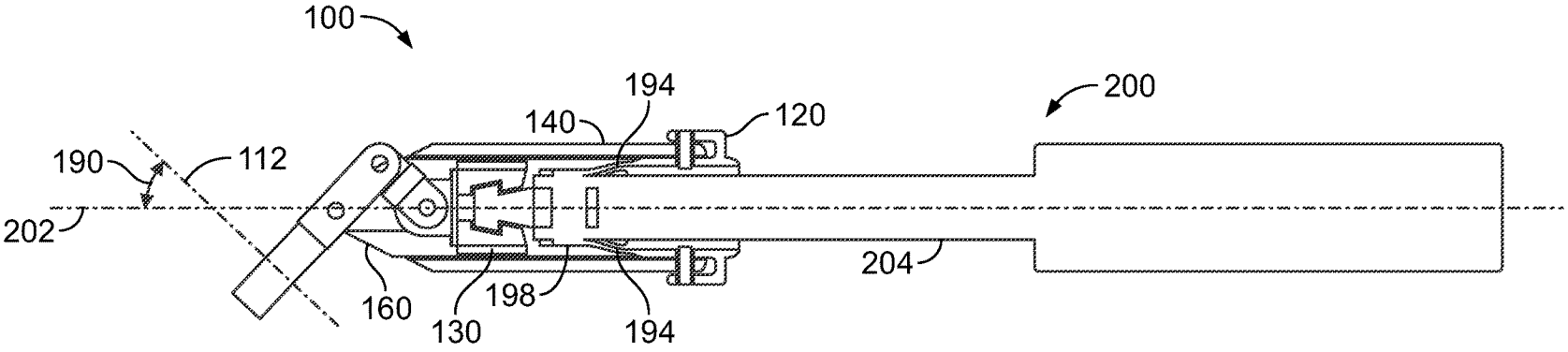
Figure 7:
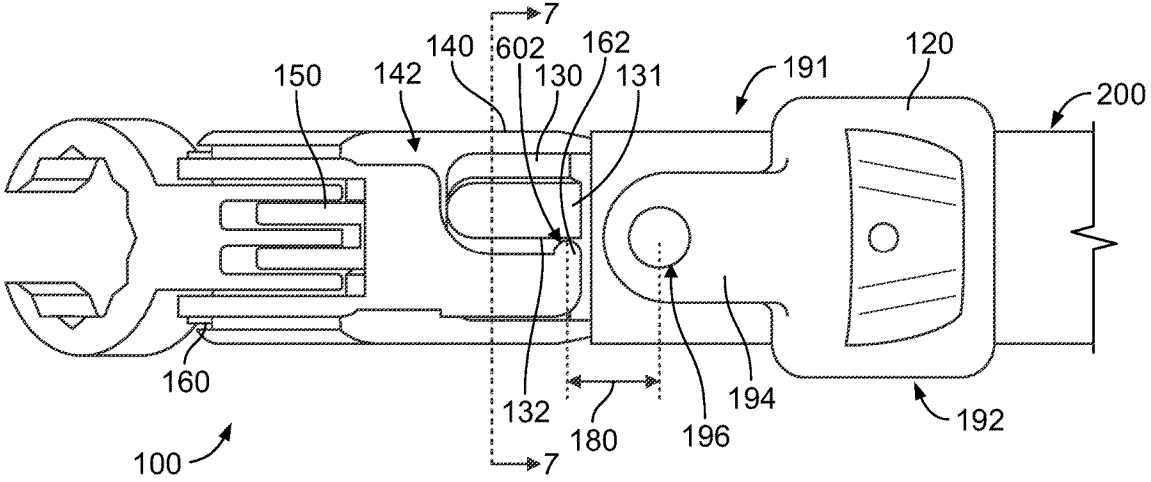
Figure 11A:
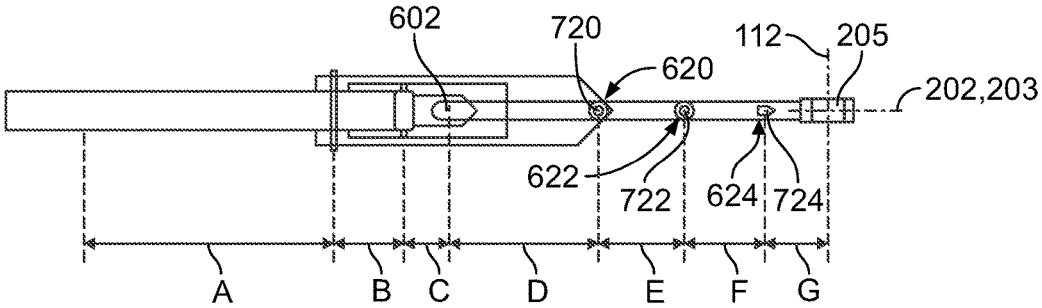
Figure 11B:
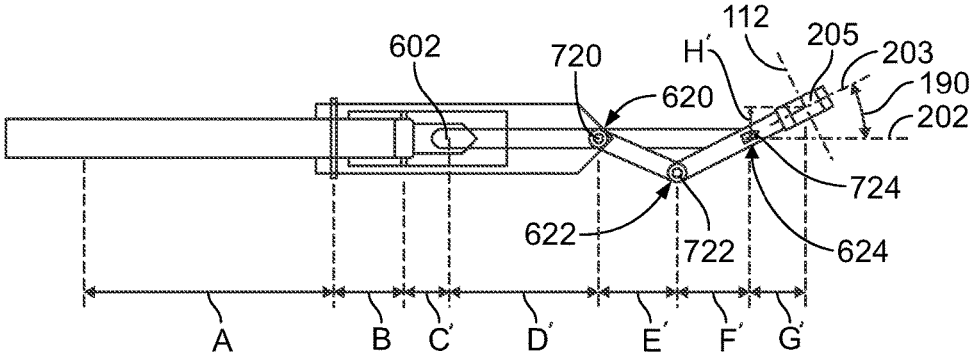
Figure 12:
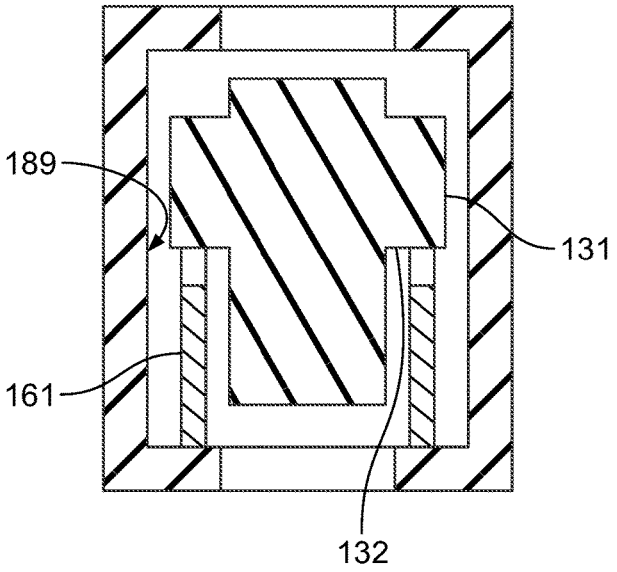
Figure 13:
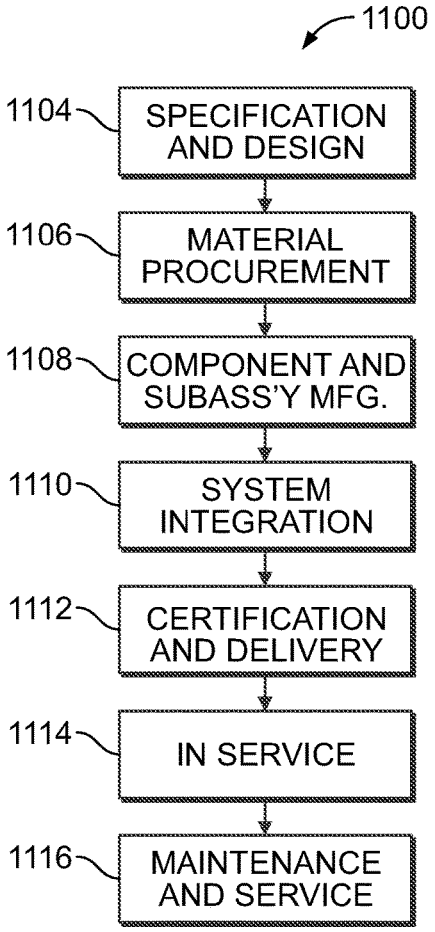
Figure 14:
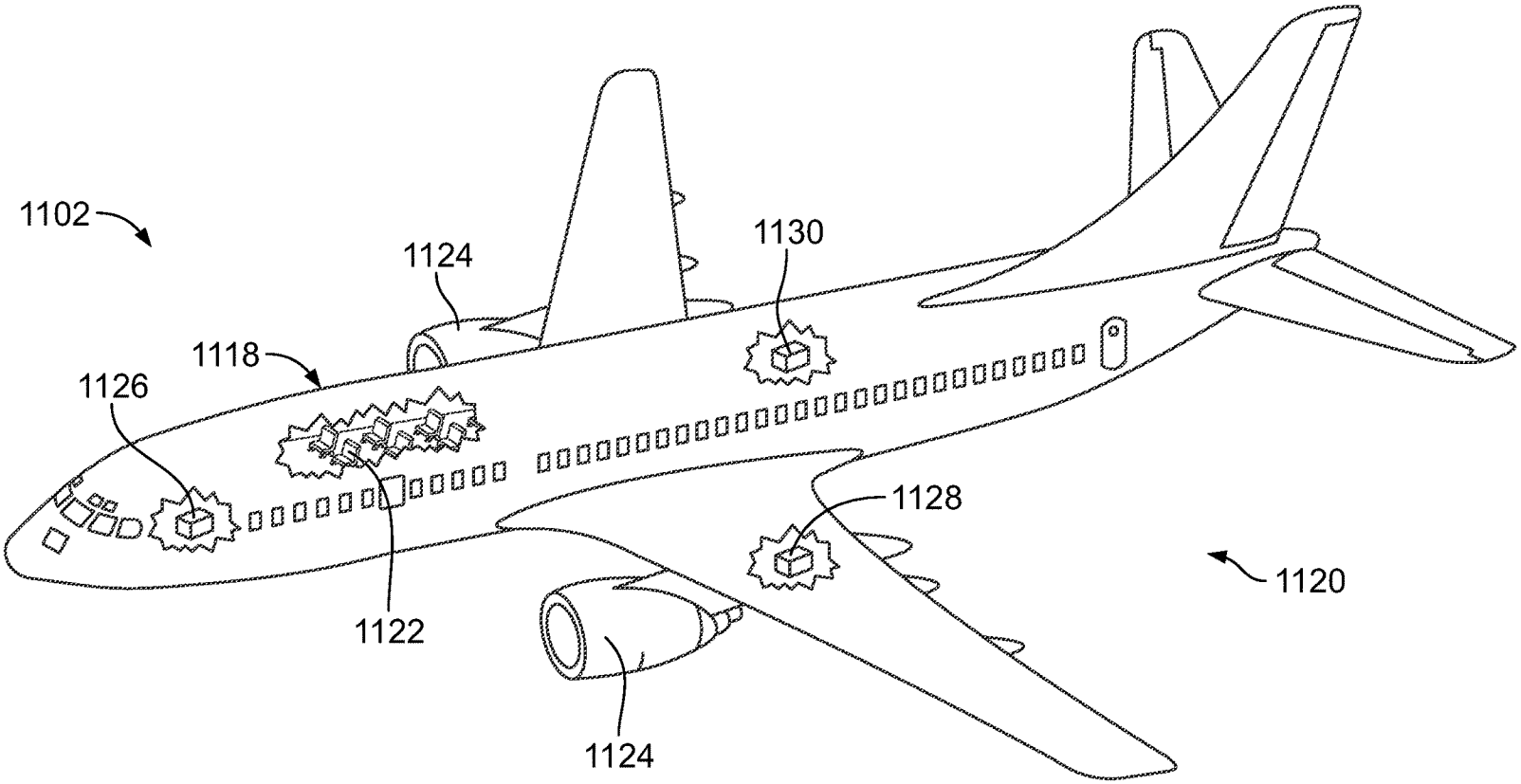

FIG. 11B is a schematic side view of the torque wrench of FIG. 1 with the second longitudinal central axis oblique relative to the first longitudinal central axis, according to one or more examples of the present disclosure;

FIG. 12 is a schematic sectional view of the torque wrench of FIG. 1, taken along a line 7-7 of FIG. 7, according to one or more examples of the present disclosure;

FIG. 13 is a block diagram of aircraft production and service methodology;

FIG. 14 is a schematic illustration of an aircraft; and

Figure 15:
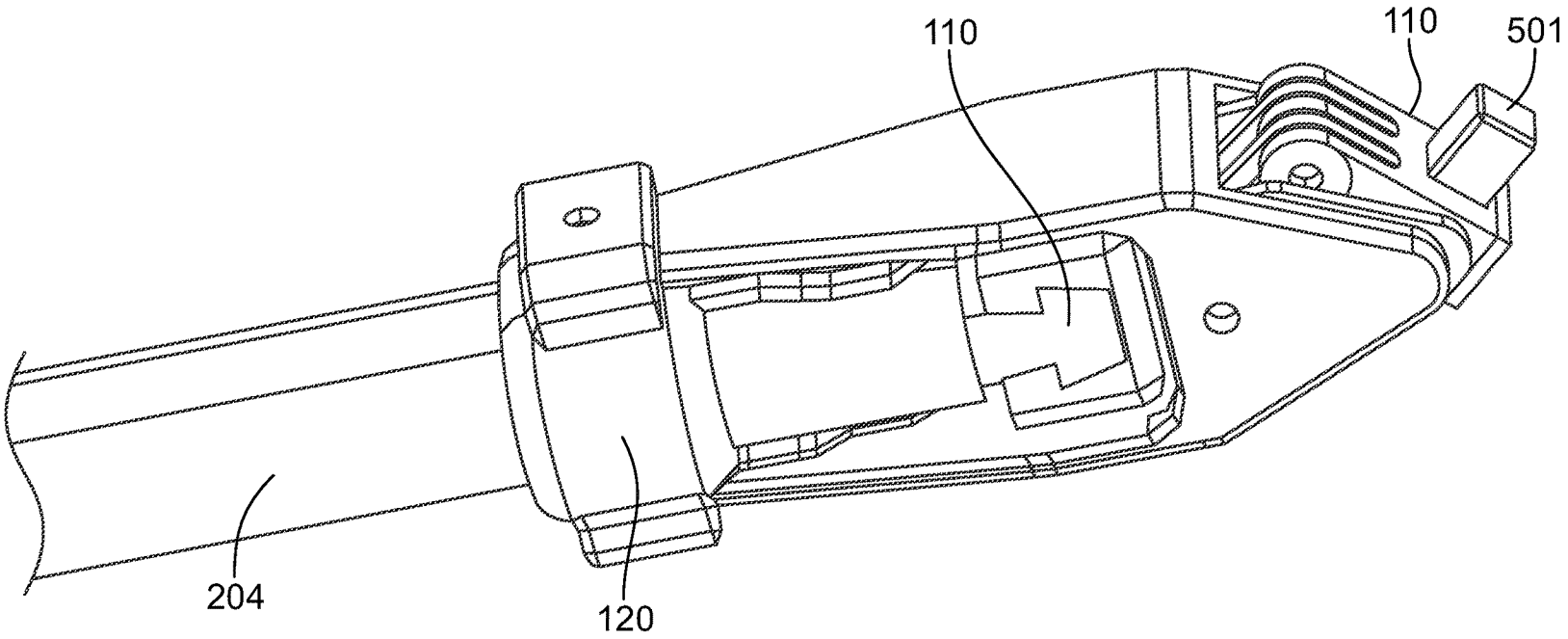

FIG. 15 is a schematic perspective view of a torque wrench configured to engage a torque application member, according to one or more examples of the present disclosure.

DETAILED DESCRIPTION

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative or optional examples of the present disclosure. Likewise, elements and/or components, if any, represented with dashed lines, indicate alternative or optional examples of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

Figure 10:
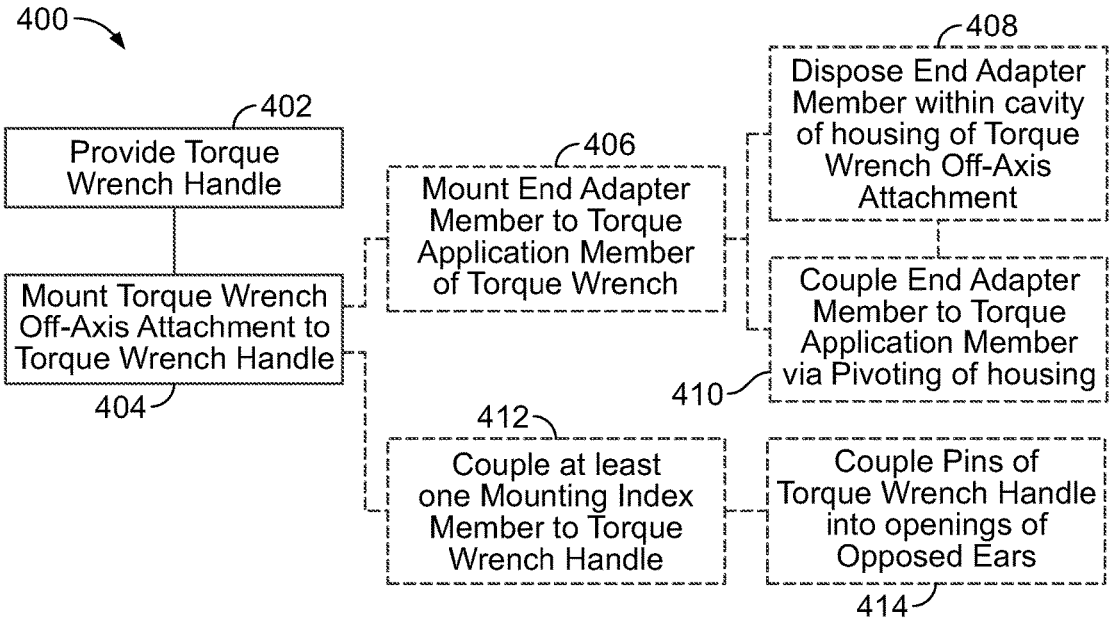

In FIGS. 10 and 13, referred to above, the blocks may represent operations and/or portions thereof and lines connecting the various blocks do not imply any particular order or dependency of the operations or portions thereof. Blocks represented by dashed lines indicate optional operations and/or portions thereof. Dashed lines, if any, connecting the various blocks represent optional dependencies of the operations or portions thereof. It will be understood that not all dependencies among the various disclosed operations are necessarily represented. FIGS. 10 and 13 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

Illustrative, non-exhaustive examples, which may or may not be claimed, of the subject matter according the present disclosure are provided below.

Referring e.g., to FIGS. 1-9, 11A, 11B, and 15 torque-wrench attachment 100, configured to be coupled to torque-wrench handle 200, is disclosed. Torque-wrench handle 200 defines first longitudinal central axis 202 and comprises torque-wrench handle barrel 204 and force-application member 210. Force-application member 210 is rotatable relative to torque-wrench handle barrel 204 about click-pivot axis 144. Click-pivot axis 144 is perpendicular to first longitudinal central axis 202. Torque-wrench attachment 100 comprises chassis 140 that is configured to be coupled to torque-wrench handle barrel 204. Torque-wrench attachment 100 also comprises wrench head 110, comprising second longitudinal central axis 203 and torque axis 112. Wrench head 110 is shaped to engage at least one of fastener 500 or torque-application member 501 aligned with torque axis 112. Second longitudinal central axis 203 and torque axis 112 have intersection point 205. Torque axis 112 of wrench head 110 has adjustable angle 190 relative to first longitudinal central axis 202 of torque-wrench handle 200 when chassis 140 is coupled to torque-wrench handle barrel 204 and aligned with first longitudinal central axis 202. Torque-wrench attachment 100 also comprises link 150 pivotally coupled to chassis 140 and wrench head 110. Torque-wrench attachment 100 additionally comprises translating element 160 pivotally coupled to wrench head 110 and linearly movable relative to chassis 140. Translating element 160 comprises contact surface 162 having centroid 602 and configured to receive a first force from force-application member 210 when chassis 140 is coupled to torque-wrench handle barrel 204 and aligned with first longitudinal central axis 202, wrench head 110 engages fastener 500, and a second force is applied to torque-wrench handle 200 in an opposite direction to the first force. When chassis 140 is coupled to torque-wrench handle barrel 204 and aligned with first longitudinal central axis 202, contact surface 162 of translating element 160 is movable along first longitudinal central axis 202 of torque-wrench handle 200, and moment arm 180 between click-pivot axis 144 and centroid 602 of contact surface 162 of translating element 160 along first longitudinal central axis 202 of torque-wrench handle 200 varies as a function of adjustable angle 190 between torque axis 112 of wrench head 110 and first longitudinal central axis 202. The preceding subject matter of this paragraph is in accordance with example 1 of the present disclosure.

Variation of a length of moment arm 180 as a function of adjustable angle 190 provides for variation of the force imparted to torque-wrench handle 200 as a function of adjustable angle 190, thereby accounting, at least to some degree, for variations in torque applied via wrench head 110 due to variations in adjustable angle 190 for a given setting of torque-wrench handle 200. For example, as adjustable angle 190 increases (e.g., torque axis 112 moves away from perpendicular with respect to first longitudinal central axis 202), moment arm 180 in the illustrated example decreases, thus allowing for a larger force (compared to when torque axis 112 is perpendicular to first longitudinal central axis 202) to be applied to torque-wrench handle 200 before exceeding a limiting setting of torque-wrench handle 200 (e.g., not causing a click of a click-type torque wrench handle). Consistency of torque applied via wrench head 110 before reaching a limit or setting of a torque wrench is provided over a range of angles between wrench head 110 and torque-wrench handle 200. Variations in torque applied to a fastener as a function of adjustable angle are compensated for automatically, without requiring calculation or adjustment by an operator, thereby saving installation time and reducing the potential for operator error.

As used herein, a longitudinal central axis may be understood as an axis passing through the geometric centroid of each cross-section of an object. It may be noted that the cross-section need not necessarily be circular. As used herein, centroid 602 may be understood as a point through which a moment arm (e.g., moment arm 180) acts to transfer forces (e.g., between wrench head 110 and torque-wrench handle 200). It may be noted that centroid 602 may be located on an exterior surface of contact surface 162 and/or at a distance from an exterior surface (e.g., in an interior of the translating element 160) A first force is applied from force-application member 210 via centroid 602 to wrench head 110 to provide a torque for turning fastener 500 when a second force (e.g., a manual force applied by an operator) is applied to torque-wrench handle 200. Torque wrench 300 includes an internal mechanism that limits or sets the amount of force that may be transferred to wrench head 110 via force-application member 210. In various examples, the limit or setting may be indicated by a "click" that may be audibly and/or tactilely observable by an operator. Click-type torque wrench mechanisms as known in the art may be utilized in various examples to set or limit an amount of force transferred from torque-wrench handle 200. (See, e.g., FIGS. 8-9 for an example of a click-type torque wrench.) Additionally or alternatively, a visual depiction of an applied force may be provided.

It may be noted that the illustrated arrangement provides one example of interconnections of various components of a torque wrench to provide linear motion of translating element 160 relative to first longitudinal central axis 202; however, other arrangements or other motions paths may be utilized in various examples. In the illustrated example, torque axis 112 and second longitudinal axis 203 are perpendicular to each other; however, different angular relationships may be employed in various examples. The particular sizes and connections between various components of torque wrench 300 may be configured in particular examples to provide a desired consistency of resulting torque applied to fastener 500 at a given setting (e.g., within 5%, within 10%, or within 25%, among others) over a given operating or effective range of adjustable angle (e.g., from −45 degrees to 45 degrees, where 0 degrees corresponds to torque axis 112 being perpendicular to first longitudinal central axis 202).

Generally, fastener 500 may be a threaded fastener configured to be accepted by a threaded receiver (e.g., threaded hole, or nut) to secure two or more components together. It may be noted that wrench head 110 may be configured to grasp and/or apply a torque to a bolt head or to a nut. In some embodiments, wrench head 110 may be configured to engage torque application member 501 (see, e.g., FIG. 15.) For example, torque application member 501 may be a square drive configured to apply a torque via a socket head, screwdriver attachment, or the like. Wrench head 110 may in various examples define a closed shape for accepting a nut, bolt head, or torque application member, or an open shape. An opening of wrench head 110 configured to accept a nut, bolt head, or torque application member may be fixed or adjustable. Further, wrench head 110 may include a ratcheting mechanism in various examples. In various embodiments, the wrench head 110 may include or be configured to engage a socket (open or closed), an extension, a crow foot, or the like.

Figure 6:
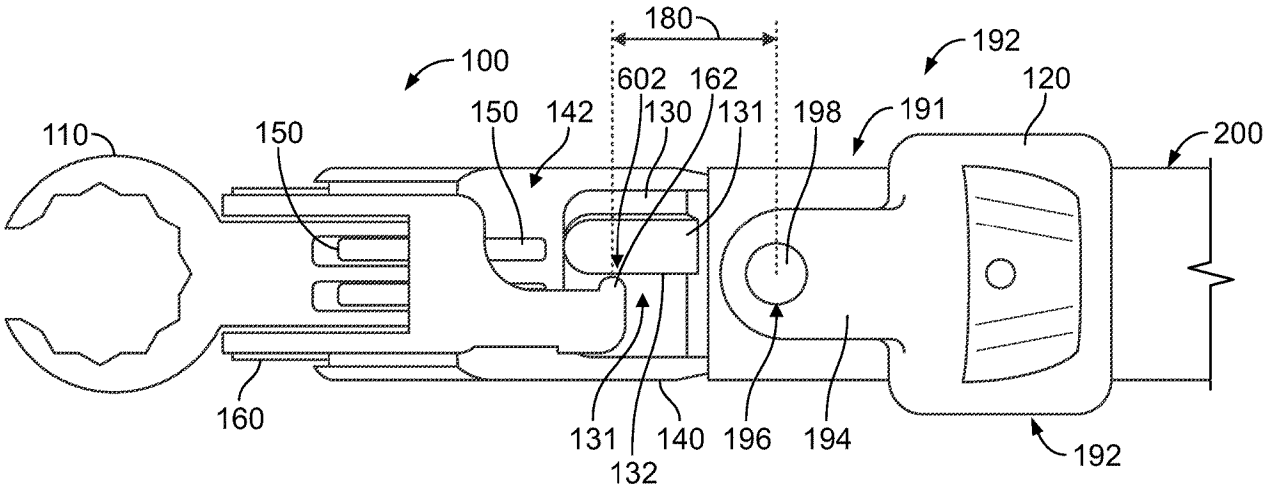

Referring generally to FIG. 1 and particularly to e.g. FIGS. 6 and 7, with chassis 140 coupled to torque-wrench handle barrel 204 and aligned with first longitudinal central axis 202, contact surface 162 of translating element 160 translates along first longitudinal central axis 202 of torque-wrench handle 200 when wrench head 110 is pivoted relative to translating element 160. The preceding subject matter of this paragraph is in accordance with example 2 of the present disclosure, and example 2 includes the subject matter of example 1, above.

Translation of contact surface 162 along first longitudinal central axis 202 provides for consistent, convenient, predictable, variation of moment arm 180 (and resulting variation in force transferred via force-application member 210 of torque-wrench handle 200) as a function of adjustable angle 190 and/or relatively easy calculation of the variation of moment arm 180 as a function of adjustable angle 190 during design or configuration of torque-wrench attachment 100 (and/or design or configuration of torque wrench 300 including torque-wrench attachment 100). The force applied to torque-wrench handle 200 at varying values of adjustable angle 190 may be consistently applied over the life of torque wrench 300 in a reliable, repeated manner. Particular dimensions and/or proportions of a given torque-wrench attachment may be readily determined based on the comparatively straight forward geometry of a linearly moving contact surface along first longitudinal central axis 202.

Referring generally to FIG. 1 and particularly to e.g. FIGS. 2-9, torque-wrench attachment 110 also comprises end adaptor member 130 configured to be coupled to force-application member 210 of torque-wrench handle 200. End adaptor member 130 comprises bearing surface 132 substantially parallel to first longitudinal central axis 202 of torque-wrench handle 200. Contact surface 162 of translating element 160 is configured to contact bearing surface 132 of end adaptor member 130 when torque-wrench attachment 100 is coupled to torque-wrench handle 200 and chassis 140 is aligned with first longitudinal central axis 202. The preceding subject matter of this paragraph is in accordance with example 3 of the present disclosure, and example 3 includes the subject matter of any of examples 1 and 2, above.

Use of end adaptor member 130 provides for convenient assembly of torque-wrench attachment 100 to torque-wrench handle 200, and/or reliable and predictable transmission of forces between torque-wrench handle 200 and wrench head 110.

Referring generally to FIG. 1 and particularly to e.g. FIGS. 2-9, end adaptor member 130 comprises dovetail opening 134 configured to be slidably coupled with a complementary feature of force-application member 210. The preceding subject matter of this paragraph is in accordance with example 4 of the present disclosure, and example 4 includes the subject matter of example 3, above.

Use of dovetail opening 134 provided for secure and convenient assembly of end adaptor member 130 to force-application member 210. The complementary feature of force-application member 210 may be a predetermined size or shape provided during manufacture and assembly of torque-wrench handle 200. End adaptor member 130 may be coupled to force-application member 210 quickly, accurately, and conveniently via a sliding or other lateral insertion of force-application member 210 into dovetail opening 134.

Still referring generally to FIG. 1 and particularly to e.g. FIGS. 6 and 7, chassis 140 comprises lateral portions 142 configured to at least partially enclose end adaptor member 130 when torque-wrench attachment 100 is coupled to torque-wrench handle 200 and chassis 140 is aligned with first longitudinal central axis 202. The preceding subject matter of this paragraph is in accordance with example 5 of the present disclosure, and example 5 includes the subject matter of any of examples 3 and 4, above.

Lateral portions 142 provide reliability and convenience of assembly. For example, end adaptor member 130 may be disposed between lateral portions to help maintain end adaptor member 130 at or near a desired position during sliding of force-application member 210 into dovetail opening 134 of end adaptor member 130.

Continuing to refer generally to FIG. 1 and particularly to e.g. FIGS. 6 and 7, end adaptor member 130 further comprises boss 131, with bearing surface 132 disposed on boss 131. The preceding subject matter of this paragraph is in accordance with example 6 of the present disclosure, and example 6 includes the subject matter of any of examples 3-5, above.

Disposition of bearing surface 132 on boss 131 provides for consistent and reliable transfer of force via contact surface 162. Boss 131 allows for a contact point or interaction point for transfer of force to be disposed laterally or radially outward of a longitudinal central axis while helping to resist cocking of components of torque wrench 300 during translation of translating element 160. Boss 131 may be sized and configured to withstand forces resulting from transmission of force from torque-wrench handle 200 to wrench head 110 and maintain a generally linear motion of translating element 160.

Referring generally to FIG. 1 and particularly to e.g. FIGS. 2-7, torque-wrench attachment 100 also comprises adaptor 120, configured to be coupled to torque-wrench handle 200. Chassis 140 is coupled to adaptor 120 and is configured to be mounted to torque-wrench handle barrel 204 via adaptor 120. The preceding subject matter of this paragraph is in accordance with example 7 of the present disclosure, and example 7 includes the subject matter of any of examples 3-6, above.

Adaptor 120 provides for convenient assembly with standard or otherwise available torque wrench handles. Adaptor 120, for example, may be shaped and sized to accept a cross-section of torque-wrench handle 200. In various examples, adaptor 120 may be configured to accept torque-wrench handle 200 with a loose or sliding fit, with adaptor 120 secured to torque-wrench handle 200 via one or more of pins, fasteners, tabs, or the like.

Continuing to refer generally to FIG. 1 and particularly to e.g. FIGS. 2-7, chassis 140 is pivotally coupled to adaptor 120. The preceding subject matter of this paragraph is in accordance with example 8 of the present disclosure, and example 8 includes the subject matter of example 7, above.

Pivotal coupling of chassis 140 to adaptor 120 allows chassis 140 to pivot with respect to torque-wrench handle 200 (e.g., second longitudinal central axis 203 may be moved from parallel with respect to first longitudinal central axis 202 to an acute angle with respect to first longitudinal central axis 202), for example, for assembly of torque-wrench adaptor 100 to torque-wrench handle 200. In the illustrated example, with chassis 140 at an initial position out of alignment with torque-wrench handle 200 (e.g., second longitudinal central axis 203 not parallel to first longitudinal central axis 202), end adaptor member 130 may be placed in a desired position within chassis 140 (e.g., between lateral portions 142). Then, chassis 140 may be pivoted into alignment with torque-wrench handle 200, with end adaptor member 130 slid on to a portion of force-application member 210 or otherwise coupled to force-application member 210. Similarly, pivoting of chassis 140 also provides for convenient disassembly (e.g., for maintenance, repair, or replacement of end adaptor member 130).

Referring generally to FIG. 1 and particularly to e.g. FIGS. 2-7, adaptor 120 comprises indexing member 191, configured to maintain moment arm 180 between click-pivot axis 144 and centroid 602 of contact surface 162 of translating element 160 along first longitudinal central axis 202 of torque-wrench handle 200 within a predetermined length range when chassis 140 is coupled to torque-wrench handle barrel 204 and aligned with first longitudinal central axis 202. The preceding subject matter of this paragraph is in accordance with example 9 of the present disclosure, and example 9 includes the subject matter of any of examples 7-8, above.

Use of indexing member 191 helps position and/or maintain torque-wrench attachment 100 and torque-wrench handle 210 in fixed relationship to each other, and provides reliability and consistency in defining the spatial relationships between the various components of torque wrench 300 and determining the variation in applied forces as a function of adjustable angle 190.

Referring generally to FIG. 1 and particularly to e.g. FIGS. 2-7, indexing member 191 comprises opposed ears 194, having openings 196 configured to mate with ends of pin 198 defining click-pivot axis 144 of force-application member 210. The preceding subject matter of this paragraph is in accordance with example 10 of the present disclosure, and example 10 includes the subject matter example 9, above.

Securement using openings 196 and pin 198 provides for convenient mounting to a pre-existing location (e.g., torque-wrench handle 200 may be provided with pin 198 in place). Use of openings 196 and pin 198 also provides use of a location directly related to click-pivot axis 144, simplifying determination of geometric relationships between components of torque wrench 300 relevant to transmission of forces and/or variation in force transferred to torque-wrench handle 200 from wrench head 110 over a range of adjustment angle 190. In the illustrated example, ears 194 are disposed on opposite sides of torque-wrench handle 200, helping to provide for secure attachment and resistance to cocking or other misalignment during use of torque wrench 300.

Referring generally to FIG. 1 and particularly to e.g. FIGS. 2-7, moment arm 180 between click-pivot axis 144 and centroid 602 of contact surface 162 of translating element 160 increases as adjustable angle 190 of torque axis 112 of wrench head 110 relative to first longitudinal central axis 202 of torque-wrench handle 200 approaches 90 degrees when chassis 140 is coupled to torque-wrench handle barrel 204 and aligned with first longitudinal central axis 202. The preceding subject matter of this paragraph is in accordance with example 11 of the present disclosure, and example 11 includes the subject matter of any of examples 1-10, above.

As adjustable angle 190 decreases (e.g., torque axis 112 moves toward perpendicular with respect to first longitudinal central axis 202), increase of moment arm 180 reduces torque applied to fastener 500 when wrench head 110 and torque axis 112 are perpendicular (or close to perpendicular) to first longitudinal central axis 202 at a setting or limitation of torque-wrench handle 200 (e.g., not causing a click of a click-type torque wrench handle), relative to when wrench head 110 and torque axis 112 are farther from perpendicular. Consistency of torque applied via wrench head 110 is provided over a range of angles between wrench head 110 and torque-wrench handle 200 for a given setting or limitation of torque-wrench handle 200.

Referring generally to FIG. 1 and particularly to e.g. FIGS. 6, 7, and 12, chassis 140 further comprises channel 189 and translating element 160 comprises second boss 161 slidably engaging channel 189. The preceding subject matter of this paragraph is in accordance with example 12 of the present disclosure, and example 12 includes the subject matter of any of examples 1-11, above.

Engagement of translating element 160 with channel 189 improves guidance of translating element 160 and provides a consistent motion path for translating element 160, and helps prevents cocking or other misalignment of translating element 160 during motion resulting from pivoting of wrench head 110. Second boss 161 may be disposed on an opposite side of force-application member 210 with respect to contact surface 132.

Referring generally to FIG. 1 and particularly to e.g. FIGS. 11A and 11B, torque-wrench attachment 100 also comprises first pivot connection 620 between chassis 140 and link 150. First pivot connection 620 has first pivot axis 720. Torque-wrench attachment 100 additionally comprises second pivot connection 622 between link 150 and wrench head 110. Second pivot connection 622 has second pivot axis 722. Torque-wrench attachment 100 also comprises third pivot connection 624 between translating element 160 and wrench head 110. Third pivot connection 624 has third pivot axis 724. When chassis 140 is coupled to torque-wrench handle barrel 204 and aligned with first longitudinal central axis 202 of torque-wrench handle 200: click-pivot axis 144 and centroid 602 are separated by a first variable distance along first longitudinal central axis 202; centroid 602 and first pivot axis 720 of first pivot connection 620 between chassis 140 and link 150 are separated by a second variable distance along first longitudinal central axis 202; first pivot axis 720 of first pivot connection 620 between chassis 140 and link 150 and second pivot axis 722 of second pivot connection 622 between link 150 and wrench head 110 are separated by a third variable distance along first longitudinal central axis 202; second pivot axis 722 of second pivot connection 622 between link 150 and wrench head 110 and third pivot axis 724 of third pivot connection 624 between translating element 160 and wrench head 110 are separated by a fourth variable distance along first longitudinal central axis 202; third pivot axis 724 of third pivot connection 624 between translating element 160 and wrench head 110 and intersection point 205 between second longitudinal central axis 203 and torque axis 112 are separated by a fifth variable distance along first longitudinal central axis 202; and third pivot axis 724 of third pivot connection 624 between translating element 160 and wrench head 110 and intersection point 205 between second longitudinal central axis 203 and torque axis 112 are separated by a sixth variable distance along a direction perpendicular to first longitudinal central axis 202. The preceding subject matter of this paragraph is in accordance with example 13 of the present disclosure, and example 13 includes the subject matter of any of examples 1-12, above.

Use of predetermined relationships between the various components as set forth by example 13 help provide for convenient prediction of variation of transferred forces between torque wrench handle 200 and wrench head 110 and/or configuration of torque-wrench attachment 100 (e.g., selection of dimensions of components of torque-wrench attachment 100) to provide a desired range of applied forces over a given desired effective or operating range of adjustable angle 190.

Referring generally to FIG. 1 and particularly to e.g. FIGS. 11A and 11B, when chassis 140 is aligned with first longitudinal central axis 202 and adjustable angle 190 between torque axis 112 of wrench head 110 and first longitudinal central axis 202 of torque-wrench handle 200 is 90 degrees, the first variable distance has a value of C, the second variable distance has a value of D, the third variable distance has a value of E, the fourth variable distance has a value of F, the fifth variable distance has a value of G, and the sixth variable distance has a value of H. Also, when chassis 140 is aligned with first longitudinal central axis 202 and adjustable angle 190 between torque axis 112 of wrench head 110 and first longitudinal central axis 202 of torque-wrench handle 200 is not 90 degrees, the first variable distance has a value of C', the second variable distance has a value of D', the third variable distance has a value of E', the fourth variable distance has a value of F', the fifth variable distance has a value of G', the sixth variable distance has a value of H', and an angle θ has a value of 90 degrees minus the adjustable angle 190. The preceding subject matter of this paragraph is in accordance with example 14 of the present disclosure, and example 14 includes the subject matter of example 13, above.

Use of predetermined relationships between the various components as set forth by examples 13 and 14 help provide for convenient prediction of variation of transferred forces between torque wrench handle 200 and wrench head 110 and/or configuration of torque-wrench attachment 100 (e.g., selection of dimensions of components of torque-wrench attachment 100) to provide a desired range of applied forces over a given desired effective or operating range of adjustable angle 190. For example, the relationships between the components may be used to determine variation of moment arms between points of force application, and consequently to determine the force at one location based on force at another location (e.g., torque that may be applied at wrench head 110 for a given setting of a torque wrench at a given angle between wrench head 110 and first longitudinal central axis 202). For example, by determining the variation in force applied to force-application member 210 as function of adjustable angle 190 over a range of adjustable angle anticipated for a given application, the appropriateness of a given design may be evaluated and adjusted as necessary.

Referring generally to FIG. 1 and particularly to e.g. FIGS. 11A and 11B, $C=C-E\times(1-\cos\theta)+F\times(1-\cos\theta)$. The preceding subject matter of this paragraph is in accordance with example 15 of the present disclosure, and example 15 includes the subject matter of example 14, above.

Referring generally to FIG. 1 and particularly to e.g. FIGS. 11A and 11B, $D'=D+E\times(1-\cos\theta)+F\times(1-\cos\theta)$. The preceding subject matter of this paragraph is in accordance with example 16 of the present disclosure, and example 16 includes the subject matter of any of examples 14-15, above.

Referring generally to FIG. 1 and particularly to e.g. FIGS. 11A and 11B, $E'=E\times\cos\theta$. The preceding subject matter of this paragraph is in accordance with example 17 of the present disclosure, and example 17 includes the subject matter of any of examples 14-16, above.

Referring generally to FIG. 1 and particularly to e.g. FIGS. 11A and 11B, $F'=F\times\cos\theta$. The preceding subject matter of this paragraph is in accordance with example 18 of the present disclosure, and example 18 includes the subject matter of any of examples 14-17, above.

Referring generally to FIG. 1 and particularly to e.g. FIGS. 11A and 11B, $G'=G\times\cos\theta$. The preceding subject matter of this paragraph is in accordance with example 19 of the present disclosure, and example 19 includes the subject matter of any of examples 14-18, above.

Referring generally to FIG. 1 and particularly to e.g. FIGS. 11A and 11B, $H'=G\times\sin\theta$. The preceding subject matter of this paragraph is in accordance with example 20 of the present disclosure, and example 20 includes the subject matter of any of examples 14-19, above.

Use of predetermined relationships between the various components as set forth by examples 15-20 help provide for convenient prediction of variation of transferred forces between torque wrench handle 200 and wrench head 110 and/or configuration of torque-wrench attachment 100 (e.g., selection of dimensions of components of torque-wrench attachment 100) to provide a desired range of applied forces over a given desired effective or operating range of adjustable angle 190.

Referring e.g., to FIGS. 1-9, 11A, 11B, and 15 torque wrench 300 is disclosed. Torque wrench 300 comprises torque-wrench handle 200 defining first longitudinal central axis 202 and comprising torque-wrench handle barrel 204. Torque wrench 300 also comprises click-type torque-wrench mechanism 220 comprising force-application member 210 extending from torque-wrench handle barrel 204. Force-application member 210 is rotatable relative to torque-wrench handle barrel 204 about click-pivot axis 144 perpendicular to first longitudinal central axis 202. Torque wrench 300 additionally comprises torque-wrench attachment 100 coupled to torque-wrench handle 200. Torque-wrench attachment 100 comprises chassis 140 coupled to torque-wrench handle barrel 204. Torque-wrench attachment 100 also comprises wrench head 110 comprising second longitudinal central axis 203 and torque axis 112. Wrench head 110 is shaped to engage at least one of fastener 500 or torque application adaptor 501 aligned with torque axis 112. Second longitudinal central axis 203 and torque axis 112 have intersection point 205. Torque axis 112 of wrench head 110 has adjustable angle 190 relative to first longitudinal central axis 202 of torque-wrench handle 200 when chassis 140 is aligned with first longitudinal central axis 202. Torque-wrench attachment 100 additionally comprises link 150, pivotally coupled to chassis 140 and wrench head 110. Torque-wrench attachment 100 also comprises translating element 160, pivotally coupled to wrench head 110 and linearly movable relative to chassis 140. Translating element 160 comprises contact surface 162 having centroid 602 and configured to receive a first force from force-application member 210 when chassis 140 is aligned with first longitudinal central axis 202, wrench head 110 engages fastener 500, and a second force is applied to torque-wrench handle 200 in an opposite direction to the first force. When chassis 140 is aligned with first longitudinal central axis 202, contact surface 162 of translating element 160 is movable along first longitudinal central axis 202 of torque-wrench handle 200, and moment arm 180 between click-pivot axis 144 and centroid 602 of contact surface 162 of translating element 160 along first longitudinal central axis 202 of torque-wrench handle 200 varies as a function of adjustable angle 190 between torque axis 112 of wrench head 110 and first longitudinal central axis 202 The preceding subject matter of this paragraph is in accordance with example 21 of the present disclosure.

Variation of a length of moment arm 180 as a function of adjustable angle 190 provides for variation of the force imparted to torque-wrench handle 200 as a function of adjustable angle 190, thereby accounting, at least to some degree, for variations in torque applied via wrench head 110 due to variations in adjustable angle 190 for a given setting of torque-wrench handle 200. For example, as adjustable angle 190 increases (e.g., torque axis 112 moves away from perpendicular with respect to first longitudinal central axis 202), moment arm 180 in the illustrated example decreases, thus allowing for a larger force (compared to when torque axis 112 is perpendicular to first longitudinal central axis 202) to be applied to torque-wrench handle 200 before exceeding a limiting setting of torque-wrench handle 200 (e.g., not causing a click of a click-type torque wrench handle). Consistency of torque applied via wrench head 110 before reaching a limit or setting of a torque wrench is provided over a range of angles between wrench head 110 and torque-wrench handle 200.

Figure 8:
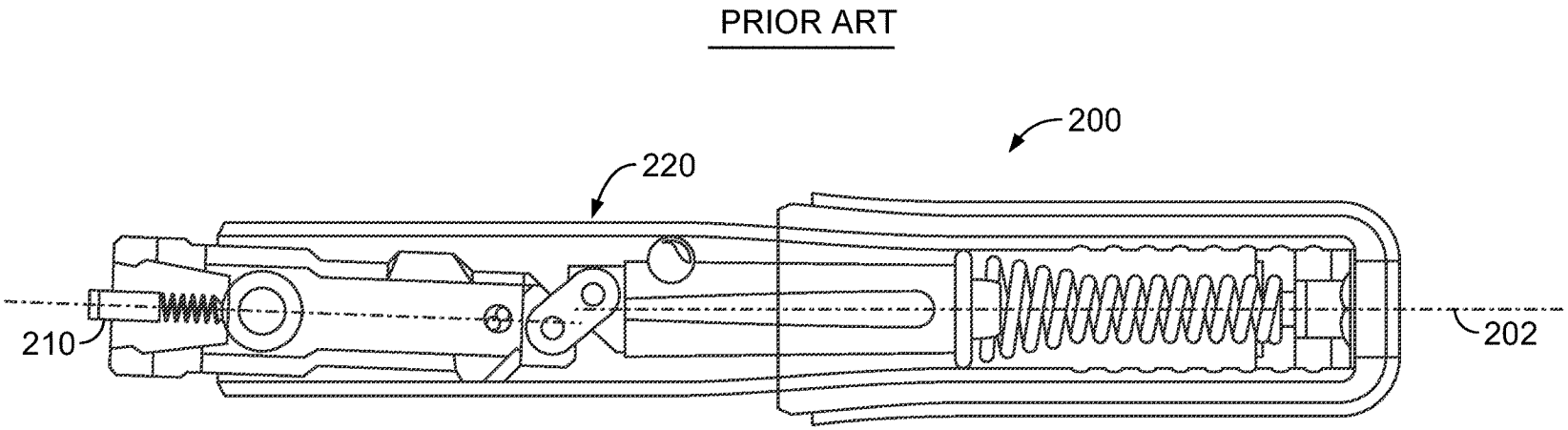
Figure 9:
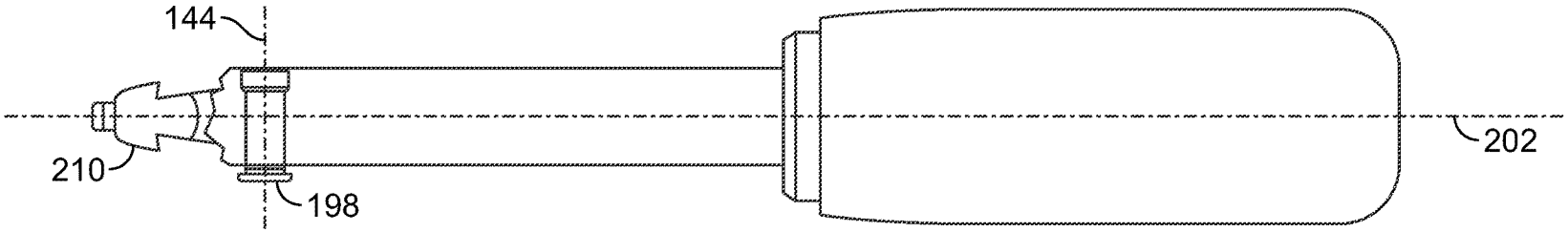

Click-type torque-wrench mechanism 220 may be configured similar to conventional designs known in the art. FIGS. 8 and 9 illustrate views of an example click-type torque-wrench mechanism 220. Click-type torque-wrench mechanisms used in conjunction with various examples (e.g., click-type torque-wrench mechanism 220 depicted in FIGS. 8 and 9) may include links, pins, arms, pawls, cams, or springs, for example, and are configured to provide a noticeable click (e.g., noticeable to an operator audibly and/or tactilely) when an applied force exceeds a predetermined setting, which may be adjustable or non-adjustable in various examples. For example, a groove and detent ball may cooperate to hold the click-type torque-wrench mechanism 220 in a first position until a force setting is met or exceeded, at which point the click-type torque-wrench mechanism moves to the second position, with the transition from the first position to the second position corresponding to the "click."

Referring generally to FIG. 1 and particularly to e.g. FIGS. 6 and 7, with chassis 140 aligned with first longitudinal central axis 202, contact surface 162 of translating element 160 translates along first longitudinal central axis 202 of torque-wrench handle 200 when wrench head 110 is pivoted relative to translating element 160. The preceding subject matter of this paragraph is in accordance with example 22 of the present disclosure, and example 22 includes the subject matter of example 21, above.

Translation of contact surface 162 along first longitudinal central axis 202 provides for consistent, convenient, predictable, variation of moment arm 180 (and resulting variation in force transferred via force-application member 210 of torque-wrench handle 200) as a function of adjustable angle 190 and/or relatively easy calculation of the variation of moment arm 180 as a function of adjustable angle 190 during design or configuration of torque-wrench attachment 100 (and/or design or configuration of torque wrench 300 including torque-wrench attachment 100). The force applied to torque-wrench handle 200 at varying values of adjustable angle 190 may be consistently applied over the life of torque wrench 300 in a reliable, repeated manner. Particular dimensions and/or proportions of a given torque-wrench attachment may be readily determined based on the comparatively straight forward geometry of a linearly moving contact surface along first longitudinal central axis 202.

Referring generally to FIG. 1 and particularly to e.g. FIGS. 2-9, torque wrench 300 also comprises end adaptor member 130 coupled to force-application member 210 of torque-wrench handle 200. End adaptor member 130 comprises bearing surface 132, substantially parallel to first longitudinal central axis 202 of torque-wrench handle 200. Contact surface 162 of translating element 160 is configured to contact bearing surface 132 of end adaptor member 130 when chassis 140 is aligned with first longitudinal central axis 202. The preceding subject matter of this paragraph is in accordance with example 23 of the present disclosure, and example 23 includes the subject matter of any of examples 21-22, above.

Use of end adaptor member 130 provides for convenient assembly of torque-wrench attachment 100 to torque-wrench handle 200, and/or reliable and predictable transmission of forces between torque-wrench handle 200 and wrench head 110.

Referring generally to FIG. 1 and particularly to e.g. FIGS. 2-9, end adaptor member 130 comprises dovetail opening 134 slidably coupled with a complementary feature of force-application member 210. The preceding subject matter of this paragraph is in accordance with example 24 of the present disclosure, and example 24 includes the subject matter of example 23, above.

Use of dovetail opening 134 provided for secure and convenient assembly of end adaptor member 130 to force-application member 210. The complementary feature of force-application member 210 may be a predetermined size or shape provided during manufacture and assembly of torque-wrench handle 200. End adaptor member 130 may be coupled to force-application member 210 quickly, accurately, and conveniently via a sliding or other lateral insertion of force-application member 210 into dovetail opening 134.

Still referring generally to FIG. 1 and particularly to e.g. FIGS. 6 and 7, chassis 140 comprises lateral portions 142 configured to at least partially enclose end adaptor member 130 when chassis 140 is aligned with first longitudinal central axis 202. The preceding subject matter of this paragraph is in accordance with example 25 of the present disclosure, and example 25 includes the subject matter of example 24, above.

Lateral portions 142 provide reliability and convenience of assembly. For example, end adaptor member 130 may be disposed between lateral portions to help maintain end adaptor member 130 at or near a desired position during sliding of force-application member 210 into dovetail opening 134 of end adaptor member 130.

Referring generally to FIG. 1 and particularly to e.g. FIGS. 2-7, chassis 140 is coupled to torque-wrench handle 200 via adaptor 120. The preceding subject matter of this paragraph is in accordance with example 26 of the present disclosure, and example 26 includes the subject matter of any of examples 24-25, above.

Adaptor 120 provides for convenient assembly with standard or otherwise available torque wrench handles. Adaptor 120, for example, may be shaped and sized to accept a cross-section of torque-wrench handle 200. In various examples, adaptor 120 may be configured to accept torque-wrench handle 200 with a loose or sliding fit, with adaptor 120 secured to torque-wrench handle 200 via one or more of pins, fasteners, tabs, or the like.

Referring generally to FIG. 1 and particularly to e.g. FIGS. 11A and 11B, torque wrench 300 also comprises first pivot connection 620 between chassis 140 and link 150. First pivot connection 620 has first pivot axis 720. Torque wrench 300 additionally comprises second pivot connection 622 between link 150 and wrench head 110. Second pivot connection 622 has second pivot axis 722. Torque wrench 300 also comprises third pivot connection 624 between translating element 160 and wrench head 110. Third pivot connection 624 has third pivot axis 724. When chassis 140 is aligned with first longitudinal central axis 202 of torque-wrench handle 200: click-pivot axis 144 and centroid 602 are separated by a first variable distance along first longitudinal central axis 202; centroid 602 and first pivot axis 720 of first pivot connection 620 between chassis 140 and link 150 are separated by a second variable distance along first longitudinal central axis 202; first pivot axis 720 of first pivot connection 620 between chassis 140 and link 150 and second pivot axis 722 of second pivot connection 622 between link 150 and wrench head 110 are separated by a third variable distance along first longitudinal central axis 202; second pivot axis 722 of second pivot connection 622 between link 150 and wrench head 110 and third pivot axis 724 of third pivot connection 624 between translating element 160 and wrench head 110 are separated by a fourth variable distance along first longitudinal central axis 202; third pivot axis 724 of third pivot connection 624 between translating element 160 and wrench head 110 and intersection point 205 between second longitudinal central axis 203 and torque axis 112 are separated by a fifth variable distance along first longitudinal central axis 202; and third pivot axis 724 of third pivot connection 624 between translating element 160 and wrench head 110 and intersection point 205 between second longitudinal central axis 203 and torque axis 112 are separated by a sixth variable distance along a direction perpendicular to first longitudinal central axis 202. The preceding subject matter of this paragraph is in accordance with example 27 of the present disclosure, and example 27 includes the subject matter of any of examples 21-26, above.

Use of predetermined relationships between the various components as set forth by example 27 help provide for convenient prediction of variation of transferred forces between torque wrench handle 200 and wrench head 110 and/or configuration of torque-wrench attachment 100 (e.g., selection of dimensions of components of torque-wrench attachment 100) to provide a desired range of applied forces over a given desired effective or operating range of adjustable angle 190.

Referring generally to FIG. 1 and particularly to e.g. FIGS. 11A and 11B, when chassis 140 is aligned with first longitudinal central axis 202 and adjustable angle 190 between torque axis 112 of wrench head 110 and first longitudinal central axis 202 of torque-wrench handle 200 is 90 degrees, the first variable distance has a value of C, the second variable distance has a value of D, the third variable distance has a value of E, the fourth variable distance has a value of F, the fifth variable distance has a value of G, and the sixth variable distance has a value of H. Also, when chassis 140 is aligned with first longitudinal central axis 202 and adjustable angle 190 between torque axis 112 of wrench head 110 and first longitudinal central axis 202 of torque-wrench handle 200 is not 90 degrees, the first variable distance has a value of C', the second variable distance has a value of D', the third variable distance has a value of E', the fourth variable distance has a value of F', the fifth variable distance has a value of G', the sixth variable distance has a value of H', and an angle θ has a value of 90 degrees minus the adjustable angle 190. The preceding subject matter of this paragraph is in accordance with example 28 of the present disclosure, and example 28 includes the subject matter of example 27, above.

Use of predetermined relationships between the various components as set forth by examples 27 and 28 help provide for convenient prediction of variation of transferred forces between torque wrench handle 200 and wrench head 110 and/or configuration of torque-wrench attachment 100 (e.g., selection of dimensions of components of torque-wrench attachment 100) to provide a desired range of applied forces over a given desired effective or operating range of adjustable angle 190. For example, the relationships between the components may be used to determine variation of moment arms between points of force application, and consequently to determine the force at one location based on force at another location (e.g., torque that may be applied at wrench head 110 for a given setting of a torque wrench at a given angle between wrench head 110 and first longitudinal central axis 202). For example, by determining the variation in force applied to force-application member 210 as function of adjustable angle 190 over a range of adjustable angle anticipated for a given application, the appropriateness of a given design may be evaluated and adjusted as necessary.

Referring generally to FIG. 1 and particularly to e.g. FIGS. 11A and 11B, $C'=C-E\times(1-\cos\theta 0)+F\times(1-\cos\theta)$. The preceding subject matter of this paragraph is in accordance with example 29 of the present disclosure, and example 29 includes the subject matter of example 28, above.

Referring generally to FIG. 1 and particularly to e.g. FIGS. 11A and 11B, $D'=D+E\times(1-\cos\theta)+F\times(1-\cos\theta)$. The preceding subject matter of this paragraph is in accordance with example 30 of the present disclosure, and example 30 includes the subject matter of any of examples 28-29, above.

Referring generally to FIG. 1 and particularly to e.g. FIGS. 11A and 11B, $E'=E\times\cos\theta$. The preceding subject matter of this paragraph is in accordance with example 31 of the present disclosure, and example 31 includes the subject matter of any of examples 28-30, above.

Referring generally to FIG. 1 and particularly to e.g. FIGS. 11A and 11B, $F'=F\times\cos\theta$. The preceding subject matter of this paragraph is in accordance with example 32 of the present disclosure, and example 32 includes the subject matter of any of examples 28-31, above.

Referring generally to FIG. 1 and particularly to e.g. FIGS. 11A and 11B, $G'=G\times\cos\theta$. The preceding subject matter of this paragraph is in accordance with example 33 of the present disclosure, and example 33 includes the subject matter of any of examples 28-32, above.

Referring generally to FIG. 1 and particularly to e.g. FIGS. 11A and 11B, $H'=G\times\sin\theta$. The preceding subject matter of this paragraph is in accordance with example 34 of the present disclosure, and example 34 includes the subject matter of any of examples 28-33, above.

Use of predetermined relationships between the various component as set forth by examples 29-34 help provide for convenient prediction of variation of transferred forces between torque wrench handle 200 and wrench head 110 and/or configuration of torque-wrench attachment 100 (e.g., selection of dimensions of components of torque-wrench attachment 100) to provide a desired range of applied forces over a given desired effective or operating range of adjustable angle 190.

Referring generally to e.g. FIGS. 1-9, and particularly to FIG. 10 (blocks 402 and 404), method 400 of assembling torque wrench 300 is disclosed. Method 400 comprises providing torque-wrench handle 200 and click-type torque-wrench mechanism 220. Torque-wrench handle 200 defines first longitudinal central axis 202 and comprises torque-wrench handle barrel 204. Click-type torque wrench mechanism 220 comprises force-application member 210 extending from torque-wrench handle barrel 204. Force-application member 210 is rotatable relative to torque-wrench handle barrel 204 about click-pivot axis 144 perpendicular to first longitudinal central axis 202. Method 400 also comprises mounting torque-wrench attachment 100 to torque-wrench handle 200. Torque-wrench attachment 100 comprises chassis 140 configured to be coupled to torque-wrench handle barrel 204. Torque-wrench attachment 100 also comprises wrench head 110, comprising second longitudinal central axis 203 and torque axis 112. Wrench head 110 is shaped to engage at least one of fastener 500 or torque-application member 501 aligned with torque axis 112. Second longitudinal central axis 203 and torque axis 112 have intersection point 205. Torque axis 112 of wrench head 110 has adjustable angle 190 relative to first longitudinal central axis 202 of torque-wrench handle 200 when chassis 140 is coupled to torque-wrench handle barrel 204 and aligned with first longitudinal central axis 202. Torque-wrench attachment 100 additionally comprises link 150, pivotally coupled to chassis 140 and wrench head 110. Torque-wrench attachment 100 also comprises translating element 160, pivotally coupled to wrench head 110 and linearly movable relative to chassis 140. Translating element 160 comprises contact surface 162, having centroid 602 and configured to receive a first force from force-application member 210 when chassis 140 is coupled to torque-wrench handle barrel 204 and aligned with first longitudinal central axis 202, wrench head 110 engages fastener 500, and a second force is applied to torque-wrench handle 200 in an opposite direction to the first force. When chassis 140 is pivotally coupled to torque-wrench handle barrel 204 and aligned with first longitudinal central axis 202, contact surface 162 of translating element 160 is movable along first longitudinal central axis 202 of torque-wrench handle 200, and moment arm 180 between click-pivot axis 144 and centroid 602 of contact surface 162 of translating element 160 along first longitudinal central axis 202 of torque-wrench handle 200 varies as a function of adjustable angle 190 between torque axis 112 of wrench head 110 and first longitudinal central axis 202. The preceding subject matter of this paragraph is in accordance with example 35 of the present disclosure.

Variation of a length of moment arm 180 as a function of adjustable angle 190 provides for variation of the force imparted to torque-wrench handle 200 as a function of adjustable angle 190, thereby accounting, at least to some degree, for variations in torque applied via wrench head 110 due to variations in adjustable angle 190 for a given setting of torque-wrench handle 200. For example, as adjustable angle 190 increases (e.g., torque axis 112 moves away from perpendicular with respect to first longitudinal central axis 202), moment arm 180 in the illustrated example decreases, thus allowing for a larger force (compared to when torque axis 112 is perpendicular to first longitudinal central axis 202) to be applied to torque-wrench handle 200 before exceeding a limiting setting of torque-wrench handle 200 (e.g., not causing a click of a click-type torque wrench handle). Consistency of torque applied via wrench head 110 before reaching a limit or setting of a torque wrench is provided over a range of angles between wrench head 110 and torque-wrench handle 200.

To mount torque-wrench adaptor 100 to torque-wrench handle 200, chassis 140 of torque-wrench adaptor 100 may be coupled to torque-wrench handle barrel 204. For example, chassis 140 may have coupled thereto an adaptor 120 sized to accept torque-wrench handle barrel 204. Adaptor 120 may be secured to torque-wrench handle barrel 204 using one or more of fasteners, pins, tabs, slots, or the like. Further, one or more of chassis 140, adaptor 120, or torque-wrench handle barrel 204 may include one or more visual cues and/or mechanical features configured to help align and mount torque-wrench handle adaptor 200 and torque-wrench handle 200 in a predetermined spatial relationship with respect to each other. For example, torque-wrench handle 200 may have one or more pins or other protrusions extending from click-pivot axis 144 or at a predetermined distance from click-pivot axis 144, and adaptor 120 may have one or more corresponding openings configured to accept the one or more pins or other protrusions to guide and align assembly of torque wrench 300.

Continuing to refer generally to FIGS. 1-9, and particularly to FIG. 10 (block 406), method 400 also comprises coupling end adaptor member 130 with force-application member 210. End adaptor member 130 comprises bearing surface 132 configured to cooperate with contact surface 162 of translating element 160 when torque-wrench attachment 100 is mounted to torque-wrench handle 200 and chassis 140 is aligned with first longitudinal central axis 202. Chassis 140 is pivotally coupled to torque-wrench handle 200 and comprises lateral portions 142 configured to at least partially enclose end adaptor member 130 when torque-wrench attachment 100 is coupled to torque-wrench handle 200 and chassis 140 is aligned with first longitudinal central axis 202. The preceding subject matter of this paragraph is in accordance with example 36 of the present disclosure, and example 36 includes the subject matter of example 35, above.

Use of end adaptor member 130 provides for convenient assembly of torque-wrench attachment 100 to torque-wrench handle 200, and/or reliable and predictable transmission of forces between torque-wrench handle 200 and wrench head 110. Lateral portions 142 provide reliability and convenience of assembly. For example, end adaptor member 130 may be disposed between lateral portions to help maintain end adaptor member 130 at or near a desired position during sliding of force-application member 210 into dovetail opening 134 of end adaptor member 130.

Continuing to refer generally to FIGS. 1-9, and particularly to FIG. 10 (blocks 408 and 410), when torque-wrench attachment 100 is mounted to torque-wrench handle 200, coupling end adaptor member 130 with force-application member 210 further comprises pivoting chassis 140 relative to torque-wrench handle 200 to cause chassis 140 to be out of alignment with first longitudinal central axis 202, and slidably coupling dovetail opening 134 of end adaptor member 130 with a complementary feature of force-application member 210. The preceding subject matter of this paragraph is in accordance with example 37 of the present disclosure, and example 37 includes the subject matter of example 36, above.

Pivoting of chassis 140 helps provide convenient assembly and/or disassembly of end adaptor member 130 and force-application member 210. For example, in some examples, chassis 140 may be pivoted out of the way for improved access to force-application member 210. In the depicted examples, chassis 140 may be initially pivoted out of alignment relative to torque-wrench handle 200, end adaptor member 130 may be disposed within chassis 140, and then chassis 140, with end adaptor member 130 disposed therein, may be pivoted back into alignment with torque-wrench handle 200, with dovetail opening 134 of end adaptor member 130 accepting the complementary feature of force-application member 210 to couple end adaptor 130 to force-application member 210 as chassis 140 is pivoted back into alignment with torque-wrench handle 200. As used herein, chassis 140 may be understood to be in alignment with torque-wrench handle 200 when a central longitudinal axis of chassis 140 is aligned with first central longitudinal axis of torque-wrench handle 200.

Continuing to refer generally to FIGS. 1-9, and particularly to FIG. 10 (blocks 412 and 414), wherein mounting torque-wrench attachment 100 to torque-wrench handle 200 further comprises coupling chassis 140 to indexing member 191 at mounting location 192 and coupling indexing member 191 to torque-wrench handle 200 to fix mounting location 192 of chassis 140 a predetermined distance from click-pivot axis 144 of torque-wrench handle 200. The preceding subject matter of this paragraph is in accordance with example 38 of the present disclosure, and example 38 includes the subject matter of any of examples 35-37, above.

Use of indexing member 191 helps position and/or maintain torque-wrench attachment 100 and torque-wrench handle 210 in fixed relationship to each other, and provides reliability and consistency in defining the spatial relationships between the various components of torque wrench 300 and determining the variation in applied forces as a function of adjustable angle 190. It may be noted that mounting location 192 may be at or along click-pivot axis 144 such that the predetermined distance of mounting location 192 from click-pivot axis 144 is zero. Alternatively, the predetermined distance may be greater than zero. For example, mounting location 192 may be disposed at a point of contact, an end point, or other reference point corresponding to interaction between torque-wrench handle 200 and torque-wrench attachment 100. One or more of detents, stops, pins and openings, slots and tabs, keyed openings, or the like may be utilized for consistent placement and/or maintenance of components of torque-wrench attachment 100 and torque-wrench handle 200 in fixed relation to each other.

Continuing to refer generally to FIGS. 1-9, and particularly to FIG. 10 (block 416), indexing member 191 comprises opposed ears 194. Coupling indexing member 191 to torque-wrench handle 200 comprises mating coupling pins 198 of torque-wrench handle 200 aligned with click-pivot axis 144 with openings 196 of opposed ears 194. The preceding subject matter of this paragraph is in accordance with example 39 of the present disclosure, and example 39 includes the subject matter of example 38, above.

Securement using openings 196 and pin 198 provides for convenient mounting to a pre-existing location (e.g., torque-wrench handle 200 may be provided with pin 198 in place). Use of openings 196 and pin 198 also provides use of a location directly related to click-pivot axis 144, simplifying determination of geometric relationships between components of torque wrench 300 relevant to transmission of forces and/or variation in force transferred to torque-wrench handle 200 from wrench head 110 over a range of adjustment angle 190. In the illustrated example, ears 194 are disposed on opposite sides of torque-wrench handle 200, helping to provide for secure attachment and resistance to cocking or other misalignment during use of torque wrench 300.

Examples of the present disclosure may be described in the context of aircraft manufacturing and service method 1100 as shown in FIG. 13 and aircraft 1102 as shown in FIG. 14. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 14, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing 1108 may be fabricated or manufactured in a manner similar to components or subassemblies produced while aircraft 1102 is in service. Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service, e.g., maintenance and service stage (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the spirit and scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

What is claimed is:

1. A torque-wrench attachment configured to be coupled to a torque-wrench handle, the torque-wrench handle defining a first longitudinal central axis and comprising a torque-wrench handle barrel and a force-application member rotatable relative to the torque-wrench handle barrel about a click-pivot axis perpendicular to the first longitudinal central axis, the torque-wrench attachment comprising:

a chassis configured to be coupled to the torque-wrench handle barrel;

a wrench head comprising a second longitudinal central axis and a torque axis, wherein:

the wrench head is shaped to engage at least one of a fastener or a torque-application adaptor aligned with the torque axis, the second longitudinal central axis and the torque axis have an intersection point, and the torque axis of the wrench head has an adjustable angle relative to the first longitudinal central axis of the torque-wrench handle when the chassis is coupled to the torque-wrench handle barrel and aligned with the first longitudinal central axis;

a link pivotally coupled to the chassis at a first pivot connection having a first pivot axis, the link pivotally coupled to the wrench head at a second pivot connection having a second pivot axis; and a translating element pivotally coupled to the wrench head at a third pivot connection having a third pivot axis, the translating element linearly movable relative to the chassis, the translating element comprising a contact surface having a centroid and configured to receive a first force from the force-application member when the chassis is coupled to the torque-wrench handle barrel and aligned with the first longitudinal central axis, the wrench head engages the fastener, and a second force is applied to the torque-wrench handle in an opposite direction to the first force, wherein, when the chassis is coupled to the torque-wrench handle barrel and aligned with the first longitudinal central axis, the contact surface of the translating element is movable along the first longitudinal central axis of the torque-wrench handle, and a moment arm between the click-pivot axis and the centroid of the contact surface of the translating element along the first longitudinal central axis of the torque-wrench handle varies as a function of the adjustable angle between the torque axis of the wrench head and the first longitudinal central axis.

2. The torque-wrench attachment according to claim 1, wherein, with the chassis coupled to the torque-wrench handle barrel and aligned with the first longitudinal central axis, the contact surface of the translating element translates along the first longitudinal central axis of the torque-wrench handle when the wrench head is pivoted relative to the translating element.

3. The torque-wrench attachment according to claim 1, further comprising an end adaptor member configured to be coupled to the force-application member of the torque-wrench handle, the end adaptor member comprising a bearing surface substantially parallel to the first longitudinal central axis of the torque-wrench handle, wherein the contact surface of the translating element is configured to contact the bearing surface of the end adaptor member when the torque-wrench attachment is coupled to the torque-wrench handle and the chassis is aligned with the first longitudinal central axis.

4. The torque-wrench attachment according to claim 3, wherein the chassis comprises lateral portions configured to at least partially enclose the end adaptor member when the torque-wrench attachment is coupled to the torque-wrench handle and the chassis is aligned with the first longitudinal central axis.

5. The torque-wrench attachment according to claim 3, further comprising an adaptor configured to be coupled to the torque-wrench handle, wherein the chassis is coupled to the adaptor and is configured to be mounted to the torque-wrench handle barrel via the adaptor.

6. The torque-wrench attachment according to claim 5, wherein the chassis is pivotally coupled to the adaptor.

7. The torque-wrench attachment according to claim 5, wherein the adaptor comprises an indexing member configured to maintain the moment arm between the click-pivot axis and the centroid of the contact surface of the translating element along the first longitudinal central axis of the torque-wrench handle within a predetermined length range when the chassis is coupled to the torque-wrench handle barrel and aligned with the first longitudinal central axis.

8. The torque-wrench attachment according to claim 7, wherein the indexing member comprises opposed ears having openings configured to mate with ends of a pin defining the click-pivot axis of the force-application member.

9. The torque-wrench attachment according to claim 1, wherein the moment arm between the click-pivot axis and the centroid of the contact surface of the translating element increases as the adjustable angle of the torque axis of the wrench head relative to the first longitudinal central axis of the torque-wrench handle approaches 90 degrees when the chassis is coupled to the torque-wrench handle barrel and aligned with the first longitudinal central axis.

10. The torque-wrench attachment according to claim 1, wherein the chassis further comprises a channel and the translating element comprises a second boss slidably engaging the channel.

11. The torque-wrench attachment according to claim 1, wherein, when the chassis is coupled to the torque-wrench handle barrel and aligned with first longitudinal central axis of the torque-wrench handle, the click-pivot axis and the centroid are separated by a first variable distance along the first longitudinal central axis;

the centroid and the first pivot axis of the first pivot connection between the chassis and the link are separated by a second variable distance along the first longitudinal central axis;

the first pivot axis of the first pivot connection between the chassis and the link and the second pivot axis of the second pivot connection between the link and the wrench head are separated by a third variable distance along the first longitudinal central axis;

the second pivot axis of the second pivot connection between the link and the wrench head and the third pivot axis of the third pivot connection between the translating element and the wrench head are separated by a fourth variable distance along the first longitudinal central axis;

the third pivot axis of the third pivot connection between the translating element and the wrench head and the intersection point between the second longitudinal central axis and the torque axis are separated by a fifth variable distance along the first longitudinal central axis; and the third pivot axis of the third pivot connection between the translating element and the wrench head and the intersection point between the second longitudinal central axis and the torque axis are separated by a sixth variable distance along a direction perpendicular to the first longitudinal central axis.

12. The torque-wrench attachment according to claim 11, wherein, when the chassis is aligned with the first longitudinal central axis and the adjustable angle between the torque axis of the wrench head and the first longitudinal central axis of the torque-wrench handle is 90 degrees, the first variable distance has a value of C, the second variable distance has a value of D, the third variable distance has a value of E, the fourth variable distance has a value of F, the fifth variable distance has a value of G, and the sixth variable distance has a value of H;

when the chassis is aligned with the first longitudinal central axis and the adjustable angle between the torque axis of the wrench head and the first longitudinal central axis of the torque-wrench handle is not 90 degrees, the first variable distance has a value of C', the second variable distance has a value of D', the third variable distance has a value of E', the fourth variable distance has a value of F', the fifth variable distance has a value of G', and the sixth variable distance has a value of H'; and an angle θ has a value of 90 degrees minus the adjustable angle.

13. The torque-wrench attachment according to claim 12, wherein $C'=C-E\times(1-\cos\theta)+F\times(1-\cos\theta)$.

14. The torque-wrench attachment according to claim 12, wherein $D'=D+E\times(1-\cos\theta)+F\times(1-\cos\theta)$.

15. The torque-wrench attachment according to claim 12, wherein $E'=E\times\cos\theta$.

16. The torque-wrench attachment according to claim 12, wherein $F'=F\times\cos\theta$.

17. The torque-wrench attachment according to claim 12, wherein $G'=G\times\cos\theta$.

18. The torque-wrench attachment according to claim 12, wherein $H'=G\times\sin\theta$.

19. A torque wrench comprising:

a torque-wrench handle defining a first longitudinal central axis and comprising a torque-wrench handle barrel;

a click-type torque-wrench mechanism comprising a force-application member extending from the torque-wrench handle barrel, the force-application member rotatable relative to the torque-wrench handle barrel about a click-pivot axis perpendicular to the first longitudinal central axis; and a torque-wrench attachment coupled to the torque-wrench handle, the torque-wrench attachment comprising:

a chassis coupled to the torque-wrench handle barrel;

a wrench head comprising a second longitudinal central axis and a torque axis, wherein:

the wrench head is shaped to engage at least one of a fastener or a torque-application member aligned with the torque axis, the second longitudinal central axis and the torque axis have an intersection point, and the torque axis of the wrench head has an adjustable angle relative to the first longitudinal central axis of the torque-wrench handle when the chassis is aligned with the first longitudinal central axis;

a link pivotally coupled to the chassis at a first pivot connection having a first pivot axis, the link pivotally coupled to the wrench head at a second pivot connection having a second pivot axis; and a translating element pivotally coupled to the wrench head at a third pivot connection having a third pivot axis, the translating element linearly movable relative to the chassis, the translating element comprising a contact surface having a centroid and configured to receive a first force from the force-application member when the chassis is aligned with the first longitudinal central axis, the wrench head engages the fastener, and a second force is applied to the torque-wrench handle in an opposite direction to the first force, wherein, when the chassis is aligned with the first longitudinal central axis, the contact surface of the translating element is movable along the first longitudinal central axis of the torque-wrench handle, and a moment arm between the click-pivot axis and the centroid of the contact surface of the translating element along the first longitudinal central axis of the torque-wrench handle varies as a function of the adjustable angle between the torque axis of the wrench head and the first longitudinal central axis.

20. A method of assembling a torque wrench, the method comprising:

providing a torque-wrench handle and a click-type torque-wrench mechanism, wherein:

the torque-wrench handle defines a first longitudinal central axis and comprises a torque-wrench handle barrel, the click-type torque wrench mechanism comprises a force-application member extending from the torque-wrench handle barrel, and the force-application member is rotatable relative to the torque-wrench handle barrel about a click-pivot axis perpendicular to the first longitudinal central axis;

mounting a torque-wrench attachment to the torque-wrench handle, wherein the torque-wrench attachment comprises:

a chassis configured to be coupled to the torque-wrench handle barrel;

a wrench head comprising a second longitudinal central axis and a torque axis, wherein:

the wrench head is shaped to engage at least one of a fastener or a torque-application member aligned with the torque axis, the second longitudinal central axis and the torque axis have an intersection point, and the torque axis of the wrench head has an adjustable angle relative to the first longitudinal central axis of the torque-wrench handle when the chassis is coupled to the torque-wrench handle barrel and aligned with the first longitudinal central axis;

a link pivotally coupled to the chassis at a first pivot connection having a first pivot axis, the link pivotally coupled to the wrench head at a second pivot connection having a second pivot axis; and a translating element pivotally coupled to the wrench head at a third pivot connection having a third pivot axis, the translating element linearly movable relative to the chassis, the translating element comprising a contact surface having a centroid and configured to receive a first force from the force-application member when the chassis is coupled to the torque-wrench handle barrel and aligned with the first longitudinal central axis, the wrench head engages the fastener, and a second force is applied to the torque-wrench handle in an opposite direction to the first force, wherein, when the chassis is pivotally coupled to the torque-wrench handle barrel and aligned with the first longitudinal central axis, the contact surface of the translating element is movable along the first longitudinal central axis of the torque-wrench handle, and a moment arm between the click-pivot axis and the centroid of the contact surface of the translating element along the first longitudinal central axis of the torque-wrench handle varies as a function of the adjustable angle between the torque axis of the wrench head and the first longitudinal central axis.

* * * * *